US008697206B2

(12) United States Patent
Katajamäki et al.

(10) Patent No.: US 8,697,206 B2
(45) Date of Patent: Apr. 15, 2014

(54) CARDBOARD AND A METHOD OF MANUFACTURE THEREOF

(75) Inventors: Seppo Katajamäki, Tampere (FI); Tuomas Mustonen, Jyväskylä (FI)

(73) Assignee: M-real Oyj, Espoo (FI)

( * ) Notice: Subject to any disclaimer, the term of this patent is extended or adjusted under 35 U.S.C. 154(b) by 366 days.

(21) Appl. No.: 10/577,137

(22) PCT Filed: Oct. 27, 2004

(86) PCT No.: PCT/FI2004/000635

§ 371 (c)(1), (2), (4) Date: May 26, 2006

(87) PCT Pub. No.: WO2005/040496

PCT Pub. Date: May 6, 2005

(65) Prior Publication Data

US 2007/0134453 A1 Jun. 14, 2007

(30) Foreign Application Priority Data

Oct. 27, 2003 (FI) ..... 20031567

(51) Int. Cl.

| | |
|---|---|
| ***B32B 1/02*** | (2006.01) |
| ***B32B 23/00*** | (2006.01) |
| *B32B 1/08* | (2006.01) |

(52) U.S. Cl.

USPC ..... 428/34.2; 428/34.1; 428/35.7; 428/35.9; 428/36.9

(58) Field of Classification Search

USPC ..... 428/34.1, 34.2, 35.7, 35.9, 36.9

See application file for complete search history.

(56) References Cited

U.S. PATENT DOCUMENTS

| | | | | | |
|---|---|---|---|---|---|
| 2,370,344 | A | * | 2/1945 | Fisher | 8/495 |
| 2,560,117 | A | * | 7/1951 | Mallary | 40/443 |
| 3,415,771 | A | * | 12/1968 | Woodruff | 524/379 |
| 3,546,066 | A | * | 12/1970 | Ware et al. | 162/175 |
| 3,808,174 | A | * | 4/1974 | Yamaguchi et al. | 528/392 |
| 4,237,147 | A | * | 12/1980 | Merten et al. | 426/590 |
| 4,239,592 | A | * | 12/1980 | Gaspar et al. | 162/175 |

(Continued)

FOREIGN PATENT DOCUMENTS

EP 1 342 768 A1 9/2003

OTHER PUBLICATIONS http://www.knowpap.com/www_demo/english/paper_technology/general/6_finishing/frame.htm (printout of "KnowPap—Finishing—demo", 8 pages).

(Continued)

*Primary Examiner* — Marc Patterson

(74) *Attorney, Agent, or Firm* — Kubovcik & Kubovcik

(57) ABSTRACT

The invention relates to cardboard used in authenticity products, comprising a fiber matrix having two surfaces, whereby the second surface of the fiber layer has a layer of surface sizing containing a marking agent in a particle form, its particle size being smaller than 50 μm. By incorporating the marking agent into the surface sizing, the particles of the marking agent can be attached to the board, at the same time decreasing their total consumption by 80 to 90% compared with a case where they would be added to pulp. By using particles of a size less than 50 μm, a top free from streaks and roughness can be formed, which streaks might otherwise weaken the quality of the product.

28 Claims, 1 Drawing Sheet

(56) References Cited

U.S. PATENT DOCUMENTS

| | | | | |
|---|---|---|---|---|
| 4,478,681 | A | 10/1984 | Müller et al. | 162/140 |
| 5,460,645 | A * | 10/1995 | Pandian et al. | 524/43 |
| 5,885,340 | A * | 3/1999 | Bailey et al. | 106/209.1 |
| 6,663,960 | B1 * | 12/2003 | Murakami et al. | 428/402 |
| 7,253,216 | B2 * | 8/2007 | Miyabayashi | 523/205 |
| 7,255,918 | B2 * | 8/2007 | Watanabe et al. | 428/342 |
| 2001/0014989 | A1 * | 8/2001 | Rohringer et al. | 8/657 |
| 2002/0017001 | A1 * | 2/2002 | Rohringer et al. | 8/648 |
| 2002/0066543 | A1 | 6/2002 | Lilly | 162/140 |
| 2002/0124978 | A1 * | 9/2002 | Hollmark et al. | 162/109 |

OTHER PUBLICATIONS http://www.knowpap.com/www_demo/english/paper_technology/5_coating/0_introduction/filmipuristinten_toimintaikkunat.jpg (printout of chart titled "Film press operational windows" showing Coat weight versus Solids content for each Surface sizing, Pigmentation and Coating, one page).

"Pigment Coating and Surface Sizing of Paper", Papermaking Science and Technology, Book 11 (2000), cover pages and Table of Contents).

* cited by examiner

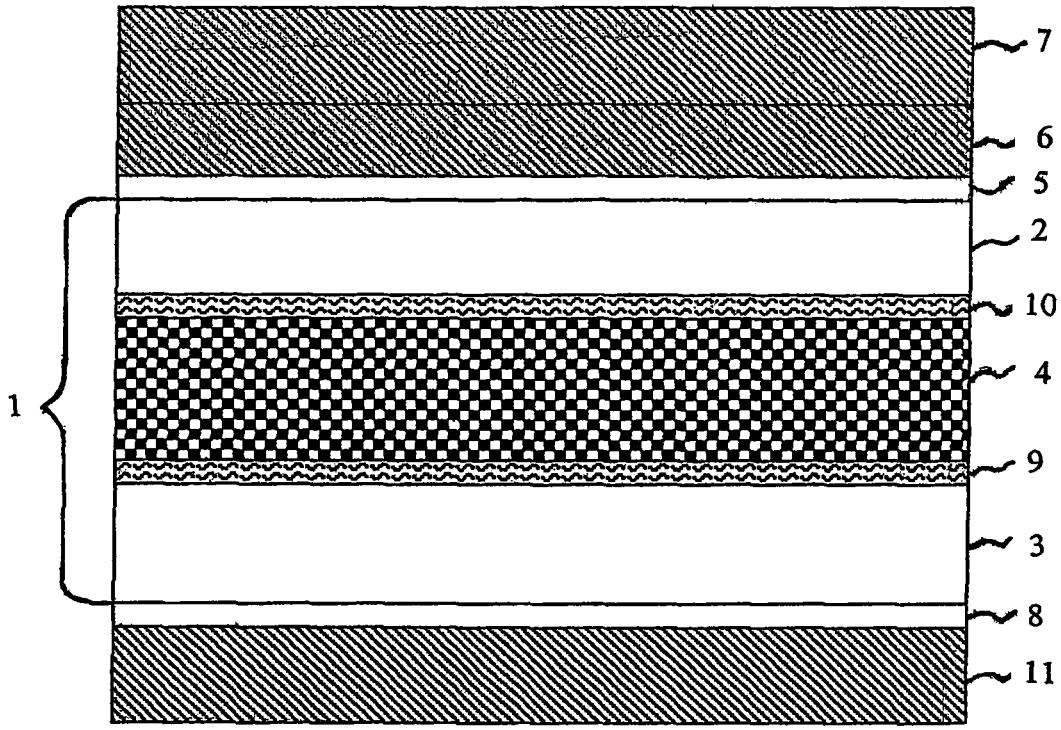
7
6
5
2
10
4
9
3
8
11
1

CARDBOARD AND A METHOD OF MANUFACTURE THEREOF

This application is a 371 of international application PCT/FI2004/000635, which claims priority based on Finnish patent application No. 20031567 filed Oct. 27, 2003, which is incorporated herein by reference.

The present invention relates to cardboard according to the preamble of Claim 1.

Generally, this kind of cardboard, which is intended to be used in authenticity products in particular, comprises a fiber matrix having two surfaces, of which at least one is provided with a layer of surface size.

The invention also relates to the method according to the preamble of Claim 22 for manufacturing the cardboard intended for authenticity products.

Security markings are used to indicate and identify the authenticity of products. An example of a traditional security marking is the watermark, which comprises an impression pattern made on the surface of paper. The purpose of the watermark is to indicate the origin of the paper. Envelopes and packages are provided with seals and tabs to ensure the integrity of the product. Recently, hologram patterns, safelines and similar marks have also been integrated into banknotes to complicate the counterfeiting of banknotes. These security markings have also been integrated into product packages, such as the plastic wrappers of compact discs. Electronic security markings include micro chips and induction coils that contain information in an electrical form, which can be used to identify and confirm the origin of the product.

In this invention, a product provided with a security marking is also called an "authenticity product".

One disadvantage of many modern authenticity products is that the security markings, which are the most difficult to forge, are manufactured separately, whereby it takes a separate stage of operation to join the product and the security marking. This concerns paper and board products, such as wrappers and crates of products in particular. Furthermore, it is difficult to attach thereto, for example, a security marking made of plastic that could be detached relatively unnoticed.

Any marking agents needed for the security markings can be incorporated into packing board by mixing them with pulp in the board machine. In that case, the marking agent can be spread evenly to the fiber matrix of the board. However, there is a problem that the consumption of marking agent becomes fairly high, because only a fraction, typically 10 to 70%, sometimes only 10 to 40%, of the particles of the marking agent are visible, when examining the surface of the board. The rest remain under other particles and fibers, when the board is examined or analyzed perpendicularly to the surface.

Another significant problem is that some marking agent gets to the circulation waters of the board machine, polluting all the devices and pipelines that are in contact with the short circulation and long circulation waters.

The purpose of the present invention is to provide a novel solution for the manufacture of board suitable for authenticity products, such as packages. The purpose of the invention in particular is to provide a new board product, the manufacture of which allows a simultaneous decrease in the consumption of marking agent and the pollution of circulation waters. The basic idea of the invention is to introduce the marking agent to the board in a mixture with the size.

An authenticity product having fluorescent particles intermixed with binding agent spread on its surface is known from the US publication 2002/0066543. In that solution, the marking is spread onto the product for example by painting, roller spreading, spraying, conventional printing methods, or with a marking pencil. The method is applicable for the security marking of relatively small surfaces. However, it is not easily applicable, or at least economical, if the authenticity marking is wanted to be introduced on large uniform surfaces.

The U.S. Pat. No. 6,060,426 is discloses a thermal paper, which is provided with a near infrared fluorescent compound to complicate the counterfeiting of the paper. In the FI publication 864951 a paper is described, which incorporates pigment in the form of grains. However, because of their stiffness, the products disclosed in these publications are not suited for packaging materials, for example. One kind of a solution for implementing a security marking for paper is given also in the WO publication 03/057785, in a method according to which the marking agent is impregnated to the paper using vegetable oils. However, in a security marking implemented by impregnation, the consumption of the marking agent is uneconomically high, as only part of the impregnated marking agent is visible, when the surface of the product is viewed.

The present invention removes the deficiencies of the methods and products accordant with the above-mentioned publications.

According to the invention, the marking agent is incorporated into the surface size layer of the fiber matrix, in particular it is incorporated into the surface size of the surface on the reverse side of the fiber matrix. In that case, the particles of the marking agent are spread onto the fiber matrix along with the sizing mixture; whereby, in order to provide a layer of an even and flawless surface, a marking agent in particle form is used having a particle size small enough so as not to form an uneven surface after spreading. In connection with the invention, it was stated that the average particle size of the marking agent should be essentially smaller than 50 μm, whereby 5% at the maximum, preferably 0.01-4%, and typically, about 1-2% of the particles have a particle size larger than 50 μm.

The invention also provides a method for the manufacture of board used in the authenticity products, according to which method a layer of surface size is spread onto the other surface of the fiber matrix of the board, the surface forming the reverse side of the board, the layer of the surface size having a marking agent mixed therewith comprising particles of less than 50 μm, as defined above. The surface-sized reverse side is preferably left uncoated. The surface forming the surface layer of the fiber matrix can be left free of surface size or a surface size not containing the marking agent is spread onto it.

To be more precise, the board according to the invention is characterized in that which is presented in the characterizing part of claim 1.

The method according to the invention is characterized in that which is presented in the characterizing part of claim 22.

The invention provides considerable advantages. Accordingly, by including the marking agent in the surface size, the particles of the marking agent can be attached to the board, whereas the total consumption of the same decreases by 80 to 90% compared with a case, in which they would be added to the pulp. By using particles with a size of less than 50 μm, a top can be formed, which is free from stripes and roughness, which otherwise could diminish the quality of the product.

The manufacturing method according to the invention is advantageous in many respects. Accordingly, by not including the marking agent in the board until at the stage of surface sizing, the particles can be prevented from entering into the circulation waters of the board machine. This reduces the need to clean the board machine and its peripherals. Special quality packing board is made from conventional board by introducing the marking agent in the surface sizing stage of the board, whereby production expenses are reduced. At the same time, a switch can flexibly be made from the manufacture of special quality packing board to that of ordinary board after washing the size press. It is also possible to make different products for different customers by changing the marking agent included in the layer of surface size.

The board provided by the invention is, for example, in the form of a track, sheet, graphical product, package or a blank of a package.

The other advantages and features of the invention are described in the following detailed description with reference to the appended drawing, which schematically presents the cross section of a folding boxboard according to the invention.

The board according to the invention comprises a fiber matrix having, on the surface forming its reverse side, a layer of surface size containing the marking agent. Such a board can be used, for example, as a blank of a package. In that case, it is essential that the marking agent is evenly spread to the whole width of the track. Otherwise, there is a risk, depending on the size of the package, that the package made from the board (blank) does not contain particles of the marking agent at all. According to the present invention, this problem can be solved by incorporating the marking agent to the surface size. As known per se, the purpose of surface sizing is to improve the moisture resistance of the board (and thus of the package). For this process stage, it is thus essential to provide the entire surface of the board with a layer of size. According to the present invention, by applying the marking agent to the surface size, it is distributed already in the production stage onto a whole board track. This decreases the waste of material, which further, in addition to the low consumption of the marking agent, decreases the production costs of the blanks, packages and other authenticity products made from the track.

It has been observed, that in order to ensure the even distribution, the particles of the marking agent have to be less than 50 μm in size. In addition, it is advantageous, if the particle size is more than 0.05 μm. Generally, the average particle size of the marking agent suitable for the invention is 1 to 45 μm, preferably 4 to 40 μm and more preferably about 10 to 30 μm. If particles larger than 10 μm are used, an important advantage of the particles being capable of being visible to the naked eye is achieved. It is especially advantageous for the marking agent to have an abrupt distribution that can be used to ensure the evenness of the security marking consisting of the marking agent. Therefore, from such a material one can make small and large boxes alike, which all have a desired, marking agent containing, uniform surface. Particularly advantageously, when the other surface of the board is provided with a layer of surface size, which typically does not contain marking agent, a blank or package is achieved, in every point of which there are both identification for authenticity and moisture resistant surfaces.

The marking agent is preferably a substance that can be optically identified. Suitable marking agents for the invention include, for example, those comprising particles that can be identified in UV light, those whose particles can be identified by means of IR radiation of X-ray radiation, and those whose particles can be identified by laser, microscopy, under the effect of heat, by means of a chemical reaction or biotechnological identification.

Typical marking agents include fluorescent inks, such as Rhodamine B (C.I. #45175) and 2.2'-(2.5-thiophendiyle)-bis (5-tert-bytyl benzoxazole) and various stilbene derivatives, cinnamenyl derivatives of benzene and biphenyl, pyrazolines and cumarin derivatives. Phosphorescent inorganic compounds, such as Eu-doped yttrium oxysulphide and Eu-doped yttrium phosphovanadate are also viable. Because size mixtures generally are aqueous (cf. below), the marking agents are preferably formulated into aqueous dispersions or solutions.

According to an advantageous embodiment of the invention, a pigment which changes its colour or other properties when exposed to laser light is used as a marking agent. Such a pigment can, for example, be in the form of granules or wafers, and the size of its particles is typically 0.05-20 μm, particularly advantageously 1-15 μm. By the selection of the pigment, the light wave length range, for example, which leads to the desired result, can be affected. As an example, the pigment can initially be white and when sufficiently exposed to a laser light having a certain wavelength, darken visible to the naked eye. One of the advantages of a security feature based on such marking agent is that it can at first be kept indistinguishable but revealed when necessary, for example, by the importer or end user of the product, or state officials. Alternatively, the manufacturer of the product can apply a symbol difficult to counterfeit on the product before releasing it to the market.

The particles of the marking agent are at least mainly evenly distributed into the layer of surface size over the surface of the fiber matrix. This means that their number per unit area in a selected part of the board surface does not deviate more than ±20%, particularly advantageously more than ±10%, from a corresponding average number/unit area, which is defined for the whole surface of the board containing the marking agent.

Typically, the layer of surface size contains a synthetic, water-soluble polymer, biopolymer or a derivative thereof. Surface sizes can be divided into several groups, whereby the main division exists between cationic and anionic surface sizes. In addition to these, reactive sizes, such as alkyl ketene dimer (AKD), are used in surface sizing to a certain extent, the main use of them otherwise being pulp sizing. Per fluorinated agents, such as perfluoro alkyl phosphate and perfluoro alkyl polymers can also be used.

Cationic surface sizes include cationic starches and starch derivatives and corresponding carbohydrate-based biopolymers. Synthetic polymers may include, e.g., styrene/acrylate copolymers (SA), polyvinyl alcohols, polyurethanes and alkylated urethanes.

Anionic surface sizes include anionic starches and starch derivatives and corresponding carbohydrate-based biopolymers, such as carboxy-methyl cellulose and its salts, alkyl celluloses, such as methyl and ethyl celluloses. Of synthetic polymers, the following could be cited: styrene/maleic acid copolymer (SMA), di-isobutylene/maleic anhydride, styrene acrylate copolymers, acrylonitrile/acrylate copolymers and polyurethanes and corresponding latex products that contain the same chemical functionalities.

Many of the above substances are delivered as viscous solutions, which are formed from the sodium or ammonium salts of the corresponding polycarboxylic acids.

Generally, the concentration of the surface size in the solution is about 0.01 to 25%, typically about 1 to 15% by weight.

The size is preferably mixed with water and any desired additives and auxiliaries are added to the composition. These substances include, e.g., anti-foaming agents, viscosity regulators, pH regulators and buffers. The marking agent is added to and mixed with the size to form at least substantially homogeneous mixture, which is spread onto the reverse side. Surface sizing is carried out in a way known per se using conventional technology, for example, a pool or film transfer press or by means of a rod coater.

In this way, a layer containing the marking agent is formed on the surface of the fiber matrix, its layer thickness being about 0.1 to 100 μm, usually about 0.5 to 50 μm. Such a layer contains about 50 to 25000, preferably about 100 to 15000 particles of marking agent per $dm^2$. Such a particle density is obtained by adding about 0.01 to 10% by weight of the marking agent to the size composition.

The surface layer of the fiber matrix can be left untreated, but it is preferably surface-sized and coated as usual, for example, first with a precoating layer and then with at least one front coat layer. If the surface layer is surface-sized, a size free of marking agent is preferably used. In that case, both surfaces of the fiber matrix can be sized by introducing the board to double-sizing, for example, in a pool or film transfer size press, whereby the sizes used in the surface sizing of the surface layer and, correspondingly, the reverse side are kept apart from each other during sizing.

The invention can be used to provide conventional packing board with a layer of marking agent, for example. The fiber matrix of such a board consist, e.g., of a single-layer product, a base board, which may comprise bleached and/or unbleached chemical hardwood pulp, bleached and/or unbleached chemical softwood pulp, bleached and/or unbleached mechanical pulp, bleached and/or unbleached chemi-mechanical pulp and/or recycled waste pulp of board manufacture, or mixtures thereof. It may also comprise a multilayer product having at least two successive fiber layers.

An example of the multilayer board is a product comprising a combination of

- a first fiber layer having an outer surface and an inner surface,
- a second fiber layer, which is spaced from the first fiber layer and which has an outer surface and an inner surface, whereby the inner surface of the second fiber layer is arranged on the side inside the first fiber layer, and
- a third fiber layer, which is fitted between the first and the second fiber layers, whereby the fiber layers form the fiber matrix of the board and the layer of surface size that contains the marking agent is arranged on the outer surface of the first fiber layer, the outer layer constituting the reverse side of the board.

In such a product, which, in principle, corresponds to a so-called conventional folding boxboard, at least one of the first and second fiber layers comprises chemical cellulose pulp. The first and second fiber layers may comprise bleached of unbleached chemical softwood and/or hardwood pulp. The third fiber layer comprises mechanical or chemi-mechanical pulp, unbleached or bleached softwood or hardwood pulp or recycled waste pulp from board manufacture. The surface that forms the outer surface of the fiber matrix may have a layer of surface size; however, it is preferably free from marking agent, as stated above.

The partial layers of the multilayer product can also be attached to each other by means of size layers. The sizes used can be the same substances as were used for the layer of surface size of the reverse side mentioned above.

The appended drawing presents a modified folding boxboard product that corresponds to the general description above. In the drawing, the reference number 1 signifies the fiber matrix, which in the case of folding boxboard comprises three superimposed fiber layers, of which the top liner 2 and the reverse side 3 consist of bleached chemical pulp mass and the centre 4 consists of mechanical pulp, which possibly contains waste pulp obtained from the manufacture. The folding boxboard is surface-sized 5 at its surface and coated with two coating layers 6, 7, of which the first layer that comes onto the top liner 2 (the layer of surface size 5) is a precoating layer 6, which generally is thinner than the front coat layer 6. A typical layer thickness is about 1 to 100 μm, whereby the thickness of the precoating layer is about 20 to 60% of the front coat layer. There may be several front coat layers 7, typically 1 to 3. Generally, the amount of coating is about 5 to 50 $g/m^2$.

The surface of the reverse side 3 has a layer of surface size 8 that contains the marking agent. The average particle size of the marking agent is essentially smaller than 50 μm; preferably not more than a few percent (e.g., about 1 to 2%) of the particles are larger than 50 μm.

Between the reverse side 3 and the centre 4 and, correspondingly, the centre 4 and the top liner 2, there are also provided layers of surface size 9, 10. The reverse side can be provided with a coating layer 11.

The folding boxboard according to the figure can be applied, e.g., to packing board, whereby the authenticity of the packaging material can be confirmed inside the package, when illuminated with a UV light, for example.

The following non-limiting examples illustrate the invention:

EXAMPLE 1

UV-fluorescent particles with an average particle size of 40 μm were integrated into a board product by means of two different methods using the same amounts of material per surface area. In Method 1, the particles were mixed with the cellulose pulp of a reverse side that corresponded to a typical production board, and laboratory sheets were prepared from the pulp, having a basis weight of 40 $m^2$. The—of the sheets illustrate the reverse side of the folding boxboard. The amount of particles dosed was 0.12 mg/sheet on an average. In Method 2, the particles were added to the surface of the sheet in a mixture with a starch-based size. The amount of size dosed onto the sheet was about 5 $g/m^2$. Thus, the same amount of particles, 0.12 mg/sheet, were dosed in a mixture with the size. In both cases, a theoretical object was to achieve a dosage of 1000 particles per square decimeter.

Defining by means of counting the actual amount of particles per square decimeter for the sheets made by the two different methods resulted in about 600 particles/$dm^2$ for the sheets made by Method 1 and in over 900 particles/$dm^2$ for the sheets made by Method 2.

Thus, it is obvious that by adding particles to the surface of the sheet along with the size is considerably more profitable in terms of material economy. The reason for this is the low retention of particles to the sheet during the removal of water and the embedding of the sheets inside the fiber sheet. If the test would have been carried out by a production scale machine, wherein the dewatering action would be much more intensive than under laboratory conditions, the difference between the methods would probably have even been higher.

EXAMPLE 2

UV-fluorescent particles of two different average particle sizes were added to the surface of a cardboard sheet along with starch-based size. The average particle size in Batch 1 was 70 μm with a wide distribution (50 to 200 μm), and in Batch 2, 40 μm with a narrow distribution. The size layer to be applied was 5 $g/m^2$ and it was made by means of a rod coater. The target dose in both cases was 1000 particles/$dm^2$ taking into consideration the different size distribution of the particles.

The prepared sheets were assessed under UV light, whereby it was discovered that the realized objective for sheets that were surface-sized with Batch 1 was only about 600 particles/$dm^2$ on an average, whereas the realized objective for sheets surface-sized with Batch 2 was over 900 particles/$dm^2$ on an average. When further examined the sheet surface-sized with Batch 1, it could be observed that the largest particles had left streaks and exited the sheet along with the surface sizing rod.

The invention claimed is:

1. Cardboard used in authenticity products comprising a multilayer fibre matrix with superimposed first and second fibre layers arranged at a distance from each other, both layers having an outer surface and an inner surface with the inner surfaces arranged to face each other, and a third fibre layer arranged between the first and the second fibre layers, said outer surfaces forming a front side and an opposite reverse side of said fibre matrix, wherein the reverse side of the fibre matrix has a surface sizing layer arranged thereon, said surface sizing layer containing a surface size and a particle-type marking agent comprising fluorescent particles having an average particle size smaller than 50 μm, the number of particles of said particle-type marking agent in said surface sizing layer being 50 to 25000 per $dm^2$, and wherein the surface size is selected from the group consisting of cationic starches, anionic starches, carboxy-methyl cellulose and its salts, methyl cellulose, ethyl cellulose, styrene/acrylate copolymers, polyvinyl alcohols, styrene/maleic acid copolymers, di-isobutylene/maleic anhydride copolymers, acrylonitrile/acrylate copolymers, perfluoro alkyl phosphate and perfluoro alkyl polymers.

2. Cardboard according to claim 1, wherein the particles of the marking agent are at least mainly evenly distributed into the surface sizing layer on the reverse side of the fibre matrix.

3. Cardboard according to claim 1, wherein the average particle size of the marking agent is 1 to 45 μm.

4. Cardboard according to claim 1, wherein the marking agent-containing surface sizing layer is spread onto a surface that constitutes the reverse side of the board.

5. Cardboard according to claim 1, wherein at least one of the first and second fibre layers comprises chemical cellulose pulp.

6. Cardboard according to claim 1, wherein the first and the second fibre layers comprise bleached or unbleached softwood and/or hardwood pulp.

7. Cardboard according to claim 1, wherein the third fibre layer comprises mechanical or chemi-mechanical pulp, unbleached or bleached softwood or hardwood pulp or recycled waste pulp from cardboard manufacture, or mixtures thereof.

8. Cardboard according to claim 1, wherein there is a surface sizing layer on the surface constituting the front side of the fibre matrix.

9. Cardboard according to claim 8, wherein the surface sizing layer on the front side of the fibre matrix is free from marking agent.

10. Cardboard according to claim 1, wherein the layers of the multilayer product are optionally attached to one another with layers of sizing.

11. Cardboard according to claim 1, wherein the surface of the surface sizing layer on the reverse side of the board is uncoated.

12. Cardboard according to claim 1, wherein the front side of the fibre matrix is coated.

13. Cardboard according to claim 12, wherein the front side is coated with a precoating layer and at least one front coat layer.

14. Cardboard according to claim 1, wherein the cardboard is in the form of a track, sheet, graphic product, package or a blank of a package.

15. A method for manufacturing a multilayer cardboard for authenticity products, comprising:

providing a fibre matrix with superimposed first and second fibre layers arranged at a distance from each other, both layers having an outer surface and an inner surface with the inner surfaces arranged to face each other, and a third fibre layer arranged the first and the second fibre layers, said outer surfaces forming a front side and an opposite reverse side of said fibre matrix, and surface sizing the reverse side of the fibre matrix with a surface size containing a surface size and a marking agent comprising fluorescent particles having an average particle size of essentially smaller than 50 μm to form a surface sizing layer having the marking agent incorporated into the layer, the number of particles of said particle-type marking agent in said surface sizing layer being 50 to 25000 per $dm^2$, and wherein the surface size is selected from the group consisting of cationic starches, anionic starches, carboxy-methyl cellulose and its salts, methyl cellulose, ethyl cellulose, styrene/acrylate copolymers, polyvinyl alcohols, styrene/maleic acid copolymers, di-isobutylene/maleic anhydride copolymers, acrylonitrile/acrylate copolymers, perfluoro alkyl phosphate and perfluoro alkyl polymers.

16. Method according to claim 15, wherein the fibre matrix is surface-sized in a pool or film transfer size press or with a rod coater.

17. Method according to claim 15, comprising surface sizing the front side of the fibre matrix with a surface sizing free from marking agent.

18. Method according to claim 17, wherein the cardboard is introduced to double sizing, whereby the sizes used for the surface sizing of the front side and, correspondingly, the reverse side are kept apart from one another in connection with sizing.

19. Method according to claim 15, wherein the marking agent is mixed with a carbohydrate-based surface size used for surface sizing to form a homogeneous mixture that is spread onto the reverse side.

20. Method according to claim 15, wherein a marking agent is used having an average particle size of 1 to 45 μm.

21. Method according to claim 15, wherein the surface sizing layer on the reverse side of the fibre matrix is coated.

22. Method according to claim 15, wherein coating layer(s) is/are only applied to the surface of the front aide of the fibre matrix.

23. Cardboard according to claim 1, wherein the average particle size of the marking agent is 4 to 40 μm.

24. Cardboard according to claim 1, wherein the average particle size of the marking agent is 10 to 30 μm.

25. Cardboard according to claim 1, wherein the surface sizing layer contains about 100 to 15000 particles of marking agent per $dm^2$.

26. Method according to claim 15, wherein about 100 to 15000 particles of marking agent per $dm^2$ are incorporated into the surface sizing layer of the reverse side.

27. Method according to claim 15, wherein a marking agent is used having an average particle size of 4 to 40 μm.

28. Method according to claim 15, wherein a marking agent is used having an average particle size of 10 to 30 μm.

* * * * *